United States Patent [19]

Salzberg

[11] 4,122,406

[45] Oct. 24, 1978

[54] MICROWAVE HYBRID POLARIZER

[76] Inventor: Edward Salzberg, 19 Black Oak Rd., Wayland, Mass. 01778

[21] Appl. No.: 796,319

[22] Filed: May 12, 1977

[51] Int. Cl.[2] ..... H01P 1/16; H01P 5/18

[52] U.S. Cl. ..... 333/10; 333/21 A

[58] Field of Search ..... 333/21 R, 21 A, 10; 343/756

[56] References Cited

U.S. PATENT DOCUMENTS

| | | | |
|---|---|---|---|
| 3,284,725 | 11/1966 | Bowman | 333/21 R X |
| 3,955,202 | 5/1976 | Young | 333/21 A X |

OTHER PUBLICATIONS

Chen et al.; *A Wide-Band Square-Waveguide Array Polarizer,* IEEE Trans. on A. & P., May 1973, pp. 389–391.

*Primary Examiner*—Paul L. Gensler

*Attorney, Agent, or Firm*—Thomas N. Tarrant

[57] ABSTRACT

A circular polarizer in the form of a waveguide coupler containing a sloped septum and using discontinuities on the septum slope together with a waist constriction to achieve good isolation and low ellipticity over a wide band.

8 Claims, 4 Drawing Figures

MICROWAVE HYBRID POLARIZER

BACKGROUND OF THE INVENTION

1. Field of the Invention

The present invention relates to microwave couplers in rf waveguide and particularly to hydrid couplers providing a shift from linear to circular polarization.

2. Description of the Prior Art

Generally this type of coupler has been known for a considerable length of time. It is believed the earliest knowledge of it extends at least back to the nineteen fifties. The most recent work and probably the closest to the applicant's invention is described in the article: "A WIDE-BAND SQUARE-WAVEGUIDE ARRAY POLARIZER", by Ming Hui Chen and G. N. Tsandoulas, published in the IEEE Transactions on Antennas and Propagation, May, 1973, pages 389 through 391. Other publications relating to this type of polarizer are cited in the above article.

The Chen and Tsandoulas coupler utilizes a stepped septum. The stepped septum is alleged to provide better isolation over a wider bandwidth than can be obtained with a sloped septum. In accordance with the article, the stepped septum, in achieving maximum isolation, loses some phase orthogonality. This requires correction with a dielectric slab.

The article describing the Chen and Tsandoulas coupler indicates that 20 db isolation over a 10 per cent frequency band is typical for a sloping septum and that their stepped septum provides 26 db over a 20 per cent band.

SUMMARY OF THE INVENTION

The invention provides a three-port sloping septum circular polarizer with three steps in the septum and a waist constriction that combine to give good isolation over a wide bandwidth plus perfect circularity at two frequency points. The polarizer is a waveguide coupler comprising a dual-rectangular-port section, a coupling section and a square-port section. The coupling section is the portion of significance and has a length of substantially 1.357 wavelengths at center frequency with a constricted waist. The three steps on the sloping septum are a first abrupt transition to a sloping portion, a step partially along the slope and a terminating step.

Thus it is an object of the invention to provide a novel sloped septum circular polarizer in waveguide.

Further objects and features of the invention will become apparent upon reading the following description together with the drawing.

DESCRIPTION OF THE PREFERRED EMBODIMENT

Figure 1:
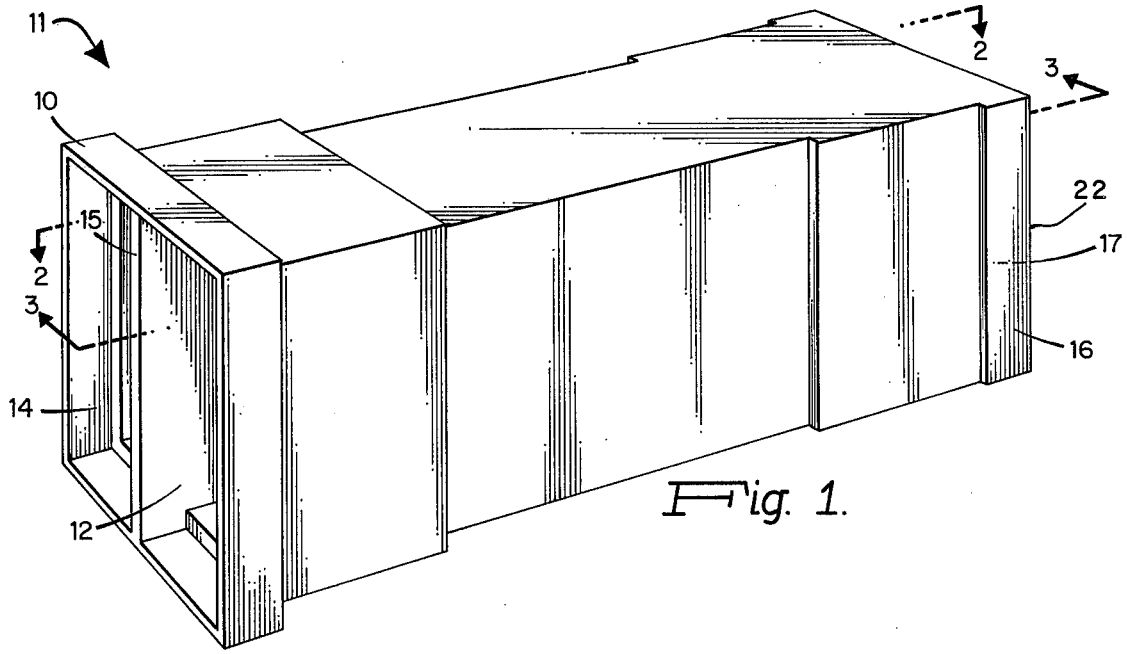
FIG. 1 is a perspective view of a hydrid polarizer according to the invention.

The polarizer of the invention has the external appearance of a hydrid coupler with two parallel passages. As can be seen in FIG. 1, end 10 of polarizer 11 has first port 12 and second port 14 in rectangular waveguide sharing common wall 15. Other end 16, however, has single third port 17 in square waveguide. Since opening 17 will simultaneously propagate energy in two orthogonally related modes, it is electrically two ports. Port 17 is described herein as one port from its mechanical aspect only. While not illustrated, ends 10 and 16 may terminate with integrally cast coupling flanges or other devices to serve particular purposes. Polarizer 11 may be die cast from aluminum or made in any conventional manner for waveguide couplers.

Polarizer 11 is considered to consist of three sections. Section 20 is a dual rectangular port section, section 21 is a coupling section and section 22 is a square port section. Section 22 may also include a conversion to circular guide. Section 20 includes two stepwise reductions 24, 25 in waveguide size as an impedance transformer from standard waveguide to coupling section 21. Section 21 is the more critical section from point-of-view of the invention and includes sloping septum 26. This section will be described in further detail below. Section 22 includes one stepwise increase in waveguide size only in the dimension transverse to the plane of septum 26.

Ports 12 and 14 each have a narrow inside dimension and a broad inside dimension and are separated by common broad wall 15. Ports 12 and 14 are normally dimensioned to a standard waveguide size. A first reduction 24 reduces the narrow dimension to dimension o and the broad dimension to dimension *h*.

First step 24 of section 20 is held over length *q* which terminates with second reduction step 25 to narrow dimension n and broad dimension j. Further length r to septum step 27 completes dual port section 20.

Step 27 is a vertical reduction in the height of septum 26 by distance *a*. Following step 27, septum 26 is further reduced in height by slope 28 having an angle *f* (substantially 20°) and terminating with step 30. Slope 28 reduces the height of septum 26 by further distance b while step 30 reduces the height by distance *c*. Second slope 31 of angle f extends to step 32 reducing the height of septum 26 by distance *d*. Step 32 extends distance e to the bottom and termination of septum 26. The vertical portion of step 30 is spaced by horizontal length *u* from step 27 while the vertical portion of step 32 is spaced by horizontal length *v* from step 27.

Steps 30 and 32 have preceding zero slope portions consistent with lengths u and v and with the slopes 28 and 31 of angle f. Corners 34 and 35 of steps 30 and 32 each have a radius of w. Ridge 33 of septum 26 is rounded with a radius of substantially 0.061 cm which is not critical and may vary irrespective of frequency.

First expansion step 36 is located length s from step 25 and expands only in the direction transverse to the plane of septum 26. Section 21 terminates and square port section 22 commences at second expansion step 37. This expansion also is only in the direction transverse to the plane of septum 26 and is spaced from step 36 by length *t*. The total width above septum 26 between steps 25 and 36 is width *k* while the same width between steps 36 and 37 is width *l*. Width *m* is the final inside width at port 17.

Septum 26 has a nominal thickness *i* while the thickness of the outside walls is noncritical except for requirements of physical strength and mechanical mating to other components. Since port 17 is square waveguide, its inside height *j* is equal to its width *m*.

Exemplary dimensions are given in the following Table I both for a specific hybrid with a center frequency of 7.900 GHZ (gigahertz) and with dimensions in terms of wavelength. As with most hybrids, electrically significant dimensions can be scaled to operate at any desired frequencies.

TABLE I

| DIMENSION SYMBOL | DIMENSION IN WAVELENGTHS | DIMENSION IN CMs FOR 7.900 GHZ |
|---|---|---|
| a | 0.138 | 0.523 |
| b | 0.126 | 0.480 |
| c | 0.1 | 0.380 |
| d | 0.161 | 0.611 |
| e | 0.1 | 0.380 |
| f | | 20° |
| g | 0.750 | 2.850 |
| h | 0.682 | 2.591 |
| i | 0.043 | 0.163 |
| j | 0.625 | 2.375 |
| k | 0.575 | 2.184 |
| l | 0.595 | 2.261 |
| m | 0.625 | 2.375 |
| n | 0.266 | 1.011 |
| o | 0.298 | 1.130 |
| p | 0.332 | 1.262 |
| q | 0.369 | 1.397 |
| r | 0.068 | 0.257 |
| s | 0.932 | 3.543 |
| t | 0.425 | 1.615 |
| u | 0.597 | 2.266 |
| v | 1.316 | 4.996 |
| w | 0.062 | 0.236 |

Due to interaction between the various dimensions, the dimensions given in Table I are not likely to be optimum nor can they be given any specific tolerance range. A change in one dimension will commonly change the tolerance on another dimension etc. Since some applications place greater importance on certain performance parameters and less on others, there would commonly be some variation in the dimensions for optimizing desired performance characteristics. For example, low ellipticity and high isolation might be more important than wide bandwidth or vice-versa.

The two examples given below are exemplary of the obtainable performance characteristics as well as some of the significant variables.

EXAMPLE I

| FREQUENCY GHZ | ISOLATION dB | ELLIPTICITY dB |
|---|---|---|
| 7.0 | 29.5 | 1.10 |
| 7.1 | 27.5 | 0.80 |
| 7.2 | 28.5 | 0.55 |
| 7.25 | 28.5 | 0.45 |
| 7.45 | 28. | 0.10 |
| 7.75 | 30. | 0.35 |
| 8.1 | 32.5 | 0.50 |
| 8.4 | 35 | 0.25 |
| 8.5 | 35 | 0.0 |
| 8.6 | 29.5 | 0.75 |

EXAMPLE II

| FREQUENCY GHZ | ISOLATION dB | ELLIPTICITY dB |
|---|---|---|
| 8.2 | 32 | 0.40 |
| 8.4 | 33 | 0.10 |
| 8.6 | 34 | 0.13 |
| 8.75 | 35 | 0.22 |
| 8.9 | 35 | 0.27 |
| 9.2 | 35 | 0.20 |
| 9.4 | 34 | 0.15 |

Example I provides a minimum isolation of 27.5 dB over a 20.5% bandwidth with a maximum ellipticity of 1.1 dB. Example II provides a minimum isolation of 32 dB over a 13.5% bandwidth. VSWR (voltage-standing-wave-ratio) is not given since it is generally low (less than 1.1) and is adequately represented in the isolation figures. As the isolation increases the VSWR generally decreases.

Figure 2:
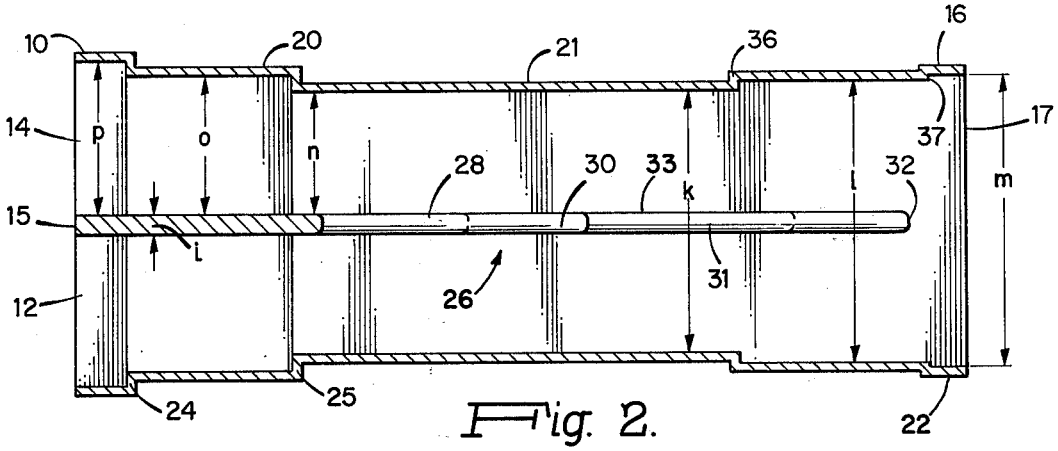
FIG. 2 is a sectional view taken along 2—2 of FIG. 1.
Figure 3:
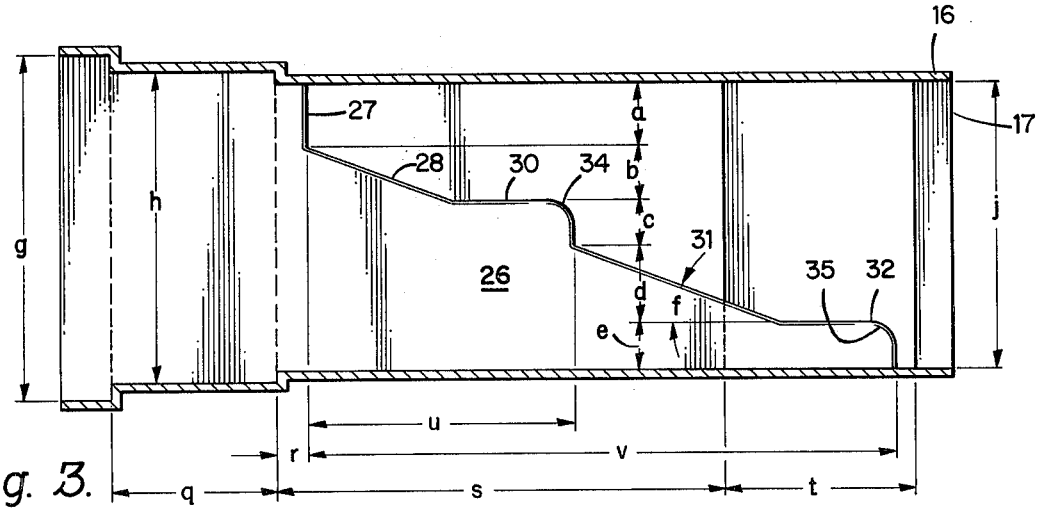
FIG. 3 is a sectional view taken along 3—3 of FIG. 1.

The most significant feature of difference in obtaining the performance of examples I and II is the amount of "waist" constriction in coupling section 21. This is represented by dimensions *k* and *l* in FIG. 2. Shrinking these dimensions increases bandwidth and vice-versa. Example I has the physical dimensions of Table I and *k* and *l* measured in wavelengths at the design center frequency are 0.575 and 0.595 respectively. For Example II these dimensions in wavelengths at the design center frequency of Example II are 0.577 and 0.596 respectively.

Examples I and II were obtained using an Alfred Model 650 sweep oscillator (uncalibrated) connected through a Hewlett-Packard Model X532B frequency meter (calibrated) to a Hewlett-Packard Model X382A variable attenuator. The variable attenuator was connected to the input of a Hewlett-Packard model X752C directional coupler. The side arm of the directional coupler was terminated with a matched dummy load. The device under test was connected to the directional coupler with a four port test adaptor having two ports matching ports 12 and 14 of the present hybrid polarizer. A third port was connected to the output of the directional coupler while the fourth port was coupler to a Filmohm model 56467 detector which in turn was connected to an oscilloscope. Thus the adaptor connects the output of the directional coupler to one of ports 12 and 14 and connects the other of ports 12 and 14 to the detector. Port 17 of the device under test was terminated with a tunable dummy load.

After obtaining the desired frequency on the frequency meter, the attenuator was adjusted to give a reasonable voltage deflection on the oscilloscope. The adapter was next disconnected and the detector connected directly to the directional coupler. Next the variable attenuator was readjusted to produce the same deflection on the oscilloscope as before. The change in dB reading on the attenuator was used as the isolation figure.

For ellipticity measurements, the device under test is connected to the directional coupler as before, but the fourth port of the adapter is connected to a dummy load instead of to the detector. The dummy load at port 17 is replaced with a circular pad and an orthogonal mode junction connected at its common dual mode port. (orthogonal mode junctions are described in U.S. Pat. No. 3,932,822.) A second port of the orthogonal mode junction is terminated with the detector while the third port is terminated with a dummy load. The orthogonal mode junction is rotated with respect to the device under test to get maximum and minimum deflections on the oscilloscope. With the junction rotated to provide maximum deflection, the attenuator is adjusted to reduce the deflection to that of the previously read minimum deflection. The change in dB read on the attenuator indicates the ellipticity.

It will be recognized that the directional coupler is not relevant to the above tests but happens to be a part of the test setup utilized.

Figure 4:
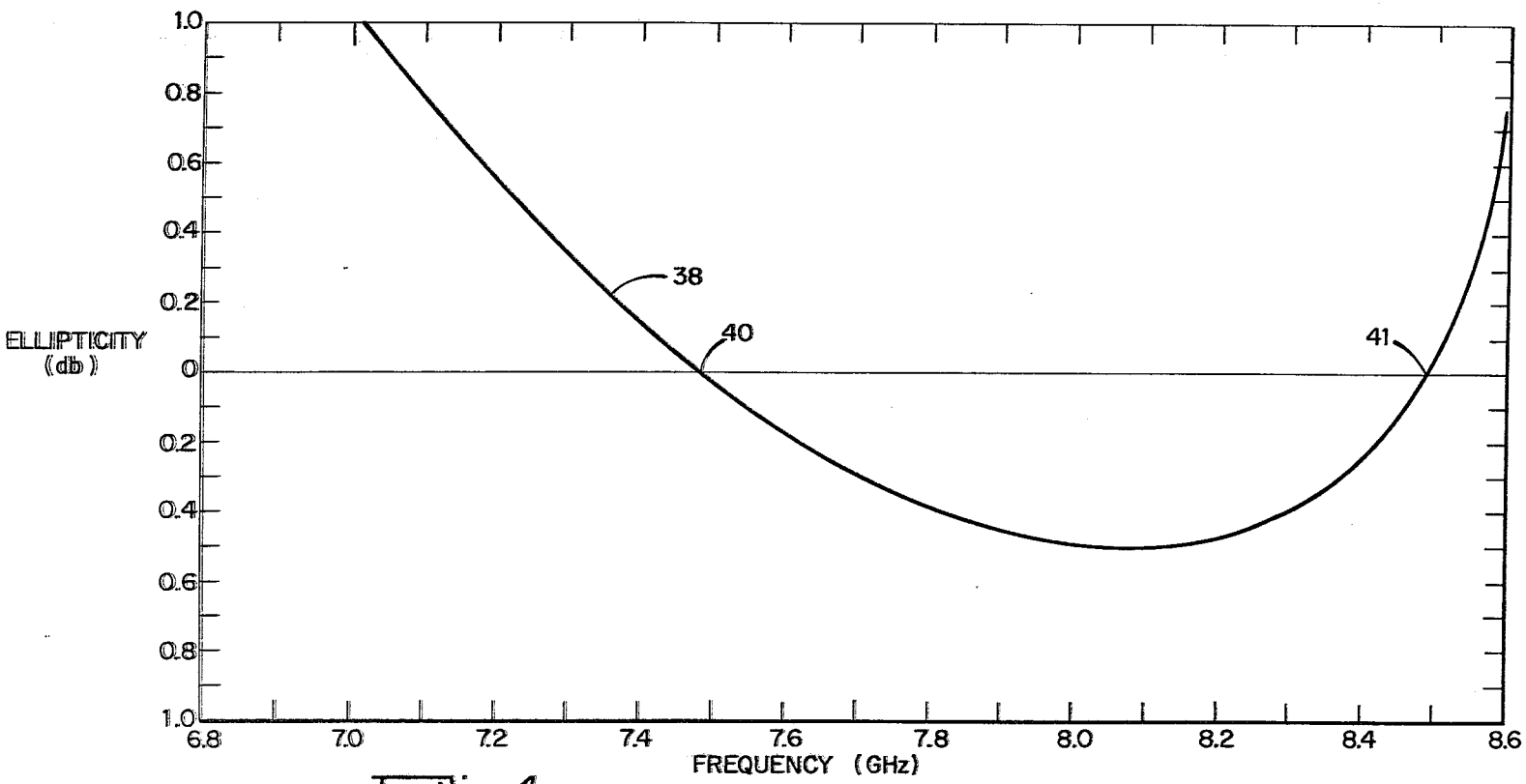
FIG. 4 is a graphical illustration of frequency vs polarization ellipticity exemplary of the inventive coupler.

It is a characteristic of the present polarizer that it exhibits zero ellipticity at two frequencies. FIG. 4 depicts ellipticity curve 38 for the device of Table I and Example I. First zero ellipticity point 40 is at 7.475 GHZ and second zero ellipticity point 41 is at 8.5 GHZ.

This is a separation of 13% of the design frequency. The separation for the device of Example II is only 10% of the design frequency. Expanding the waist constriction of coupling section 21 moves the closed portion of the curve closer to the zero ellipticity line decreasing the separation between the zero ellipticity points and narrowing the bandwidth.

While the invention has been described with respect to specific embodiments, it is the general geometrical combination that is considered to be the invention rather than any specific critical dimensions. Accordingly, it is intended to cover the invention as set forth in the following claims.

I claim:

1. A microwave hybrid polarizer comprising:

(a) a dual port section consisting of first and second ports of rectangular waveguide on either side of a common wide wall septum;

(b) a coupling section from said ports of rectangular waveguide to square waveguide in which said septum is successively reduced in height with a first step, a first slope, a second step, a second slope and a final step terminating said septum;

(c) a square waveguide section connected to said coupling section; and, (d) a constriction transverse to the plane of said septum in said coupling section to a width less than that of said square waveguide section by enough to provide two zero ellipticity points separated in frequency in the polarization response curve of said polarizer.

2. A microwave hybrid polarizer according to claim 1 wherein said dual port section, said coupling section and said square waveguide section are integrally formed in one piece.

3. A microwave hybrid polarizer according to claim 1 wherein said coupling section has a length of substantially 1.357 wavelengths at the design center frequency.

4. A microwave hybrid polarizer according to claim 3 wherein the portion of said septum in said coupling section has a length of substantially 1.316 wavelengths at the design center frequency.

5. A microwave hybrid polarizer according to claim 1 wherein said first slope and said second slope each have an inclination angle of substantially 20°.

6. A microwave hybrid polarizer according to claim 5 wherein each of said second step and said final step have a horizontal portion and a vertical portion, the two horizontal portions being approximately the same length and the two vertical portions each being substantially 0.1 wavelength in height at the design center frequency.

7. A microwave hybrid polarizer according to claim 6 wherein the distance between the vertical portions of said first step and said second step is substantially 0.597 wavelengths and the distance between the vertical portions of said first step and said final step is substantially 1.316 wavelengths at the design center frequency.

8. A microwave hybrid polarizer according to claim 1 wherein the inside height of said coupling section is substantially 0.625 wavelengths and the inside width of said coupling at its most constricted portion is substantially 0.575 wavelengths at the design center frequency.

* * * * *